United States Patent [19]

Louis

[11] Patent Number: 4,965,708

[45] Date of Patent: Oct. 23, 1990

[54] LIGHT ASSEMBLY HAVING A MAGNETIZED BASE

[76] Inventor: Jean-Marie W. Louis, Leuvensesteenweg 146, 3210 Tielt-Winge, Belgium

[21] Appl. No.: 241,049

[22] Filed: Sep. 6, 1988

[51] Int. Cl.[5] ..... F21L 15/18

[52] U.S. Cl. ..... 362/398; 362/373; 362/419

[58] Field of Search ..... 362/294, 376, 398, 373, 362/391, 407, 419

[56] References Cited

U.S. PATENT DOCUMENTS

| | | | |
|---|---|---|---|
| 2,945,946 | 7/1960 | Moffatt | 362/294 |
| 2,951,935 | 9/1960 | Cole | 362/294 |
| 3,325,639 | 6/1967 | King | 362/398 X |
| 3,666,938 | 5/1972 | Dolega | 362/398 |
| 4,422,137 | 12/1983 | Watts | 362/398 X |
| 4,506,317 | 3/1985 | Duddy | 362/398 X |
| 4,621,310 | 11/1986 | Keating | 362/376 X |

*Primary Examiner*—Ira S. Lazarus
*Assistant Examiner*—Peggy Neils
*Attorney, Agent, or Firm*—Edward D. Gilhooly

[57] ABSTRACT

A light assembly having a magnetized base for attachment to a support surface. A reflector and an incandescent lamp are coupled to the magnetized base through a gooseneck and is manipulable to a wide range of lighting positions. The reflector includes cooling openings and a curved configuration to intensify lighting from the lamp. The magnet is positioned at the bottom of the base for maximum attraction to the support surface.

7 Claims, 1 Drawing Sheet

2
4
6
8
10
12
14
16
20
20a
22
24
26
26a
28
30
32
34
36
38
40
42
46
50
60
62
63
64
66
68
70
72
74
76
77
78
80
82
84
88

LIGHT ASSEMBLY HAVING A MAGNETIZED BASE

BACKGROUND OF THE INVENTION

1. Field of the Invention

This invention relates to portable lights and more particularly, to a lighting assembly having a magnetized base.

2. Description of the Invention

Since the introduction of the incondescent bulb, countless lighting devices and fixtures have been designed to use the lamp for various purposes. Among such designs, portable lights have been developed that permit lighting in an endless number of applications, such as in automobile repair and the like where normal room or outdoor lighting is inadequate or unavailable. Such light devices must be capable of being used under a multitude of varying conditions in a manner to illuminate an adjacent area with safety and effectiveness. One popular type of known design employs a hood to suspend light the area being illuminated. Such hook attachments are highly unsatisfactory in permitting secure attachment of the light under all circumstances and are deficient in attaining adequate adaptability to permit manipulation of light to illuminate the area desired. In addition, prior devices of the portable type are incapable of adequate attachment under all conditions. Consequently, a need exists for improvements in light assemblies capable of being adaptable to a wide range of uses and lighting needs.

SUMMARY OF THE INVENTION

It is therefore an objective of the invention to provide an improved light assembly having a magnetized base. The light assembly herein disclosed utilizes a magnetic field that is strongly attracted to a metal surface and the like for rigid attachment of the light assembly from above, along side, or below the surface being illuminated. A gooseneck connection is affixed to the base and carries a camp for the selective adjustment of the light beam in multiple directions as required under the conditions being encountered. A reflector having cooling vents or ports effectively directs a high intensity light beam to the area desired. The light assembly of the invention is versatile and adaptable to a wide range of conditions and applications. Accordingly, the light assembly herein disclosed can be used in environments in which known light devices are ineffective and not useable. The invention may be used, among numerous uses, in vehicle repairs and service, workshops, production lines, utility plants, ships, airplanes, home repair, mining, city services, road construction, and the like.

DESCRIPTION OF THE PREFERRED EMBODIMENT

Figures 1, 2, 3:
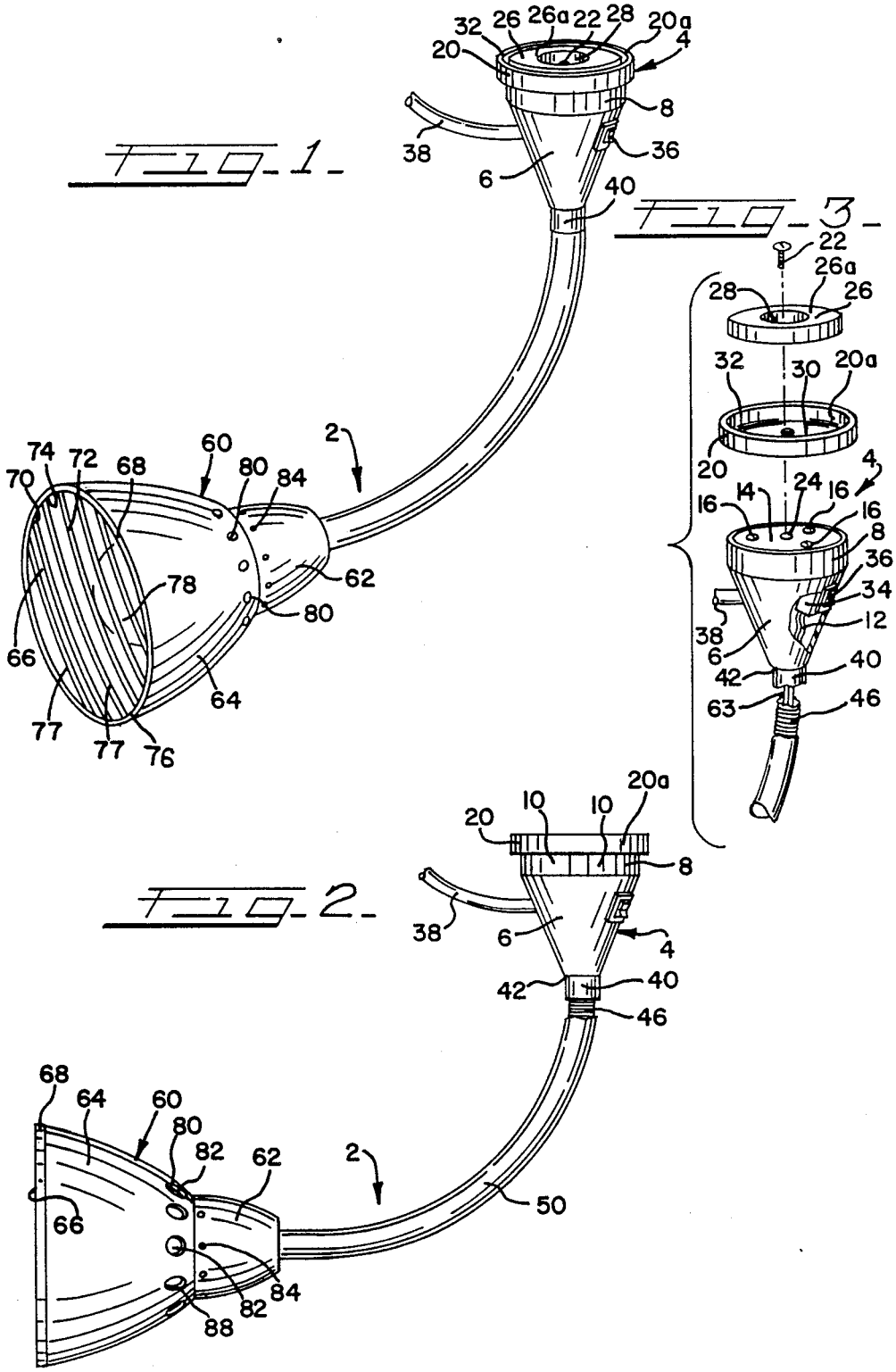
FIG. 1 is a perspective view of the light assembly of the invention.
FIG. 2 is a side elevational view of the light assembly of FIG. 1.
FIG. 3 is a partial perspective view, with parts exploded and broken away, of the magnetized base of the light assembly of the invention.

Referring now to FIGS. 1–3, there is illustrated the light assembly of the invention, generally designated by reference numeral 2. The light assembly is provided with a magnetized base assembly 4 having a hollow upper portion 6 forming a switch housing with a trunicated cone configuration. A gripping area 8 is integrally provided on the upper portion 6 and includes a plurality of flat areas 10 circumferentially around the base assembly 4. The flat areas 8 provide gripping surfaces for access to the interior 12 (FIG. 3) of the upper portion 6. A disk member 14 is positioned within the gripping area 8 and is attached by threaded member 16 to holes (not shown) in the upper base portion 6. The upper portion 6, gripping areas 10, and disk member 14 are all fabricated from a tough plastic material and the like.

A dish-like magnet holder 20 of a metallic material is affixed by threaded member 22 to a threaded hole (FIG. 3) in disk member 14. The magnet holder 20 includes a projecting circular rim **20*a* which surrounds a six-pole magnet 26. The magnet 26 has a flat cylindrical configuration with a central opening 28. The magnet 26 is affixed to base 30 (FIG. 3) of the magnet holder 20 by an adhesive or suitable bonding technique. It should be apparent that magnet holder 20 is formed as as an integral body having circular base 30 and rim 20*a* projecting downward from upper portion 6, such that the continuous edge 32 forms a bearing surface to bear against a support surface or object to which the base assembly 4 is magnetically affixed. The exposed face 26*a* of magnet 26 lies in a plane slightly beneath the plane of the edge 32 of the magnet holder 20. The base assembly 4 may be placed on any metallic surface and the like such that the magnetic force of magnet 26 causes the base to be mounted firmly in place. The magnet 26 is capable of adequately securing the light assembly 2, even when the confronting face 24*a* of the magnet is only partially positioned adjacent a support surface or when all or a portion of the edge 32 of the rim 20*a*** contacts the support surface or support object.

The upper portion 6 of base assembly 4 houses a conventional switch mechanism 34 having an exteriorly accessible on-off actuator 36. An electrical power cord 38 is electrically coupled to the switch mechanism 34 and is arranged to connected to an external power source (not shown). A metallic sleeve 40 is threadedly fitted into an upper opening 42 in base assembly 4 and retains an end portion of a metallic conduit 46 forming a gooseneck connection. The conduit 46 may be affixed to the sleeve 40 by any suitable technique, such as frictional engagement and the like. The metallic conduit 46 is formed from a plurality of interconnected segments of known design that are relatively movable with respect to each other so that the conduit can be adjusted in any directions into a multitude of shapes with the conduit assuming unlimited curved, linear, or combined configurations. A plastic or rubber sleeve 50 covers the conduit 46 and sleeve 40 as shown in FIG. 1.

A reflector and lamp assembly 60 is mounted on the opposite end of conduit 46 and includes a sleeve (not shown) which interfits with conduit 46 in a similar manner as the opposite end does with sleeve 40. The reflector and lamp assembly 60 includes a hollow lamp housing 62 having a lamp socket (not shown) of conventional design mounted therein and being affixed to the internal sleeve (not shown) which is in turn affixed to the end of the conduit 46. As seen in FIG. 3, electrical leads 63 extend through the conduit 46 to connect the switch mechanism 34 to the lamp socket to supply an electrical current thereto. The electric current may be from a suitable alternating current source or direct current from a rechargable pack and the like.

A concave metallic reflector 64 or a reflector constructed from a PVC or plastic material is integrally formed on the lamp socket housing 62 and has a light emitting open end 66. The reflector 64 may have an polished internal surface and has an expanded outer edge 68, which is rounded and creates an internal groove 70 adjacent open end 66. A protective grill 72, having a circular wire periphery 74, is snapped fitted into groove 70 of the reflector 64. The grill periphery 74 is split at point 76 to permit removal and insertion of the grill into groove 70 as desired. A plurality of parallel grill segments 77 extend across the grill in attachment to the periphery 74. An incondescent lamp 78, or other lamp, of suitable wattage is mounted on the lamp socket (not shown) in a conventional manner. A plurality of air ports 80 are formed around the base of the reflector 64. The ports 80 serve as cooling vents and are formed by punching out portions 82 of the reflector 64. The portions 82 form a plurality of air passages and also partially block the light emitted from the ports 80. A plurality of cooling holes 84 are also circumferentially provided in lamp socket housing 62. The entire housing and lamp socket assembly may be constructed to be waterproof, oil resistant, and sparkproof for safety and long wear.

In use, the magnetized base 4 can be firmly attached to a support surface in any orientation. The gooseneck connection formed by conduit 46 permits light reflector 64 to be manipulated into countless shapes from a linear configuration to any curved, multi-curved, or combined curved and linear configuration to orient the light beam from lamp 78 in any desired direction, regardless of the orientation of the base assembly 4. The reflector 64 directs a high intensity light with cooling provided by ports 80 and holes 84. The punched out portions 82 insure that disturbing light is not directed outward from the sides of the reflector 64. The light assembly 2 is easily transported from place to place, but still is capable of a near permanent installation when placed in contact with magnetically attractive surfaces or objects.

What is claimed is:

1. A light assembly comprising base means for attachment to a magnet for magnetically affixing said base means to a support object, said base means further having a magnet holder for holding said magnet, a light socket for receiving a lamp, said lamp socket being connected to said base means by a flexible gooseneck connection, said magnet is in the form of a disk, said magnet holder is in the form of a dish having a circular flat base and a continuous rim projecting away from said base, said magnet being affixed to said base within said rim, the edge of said rim projects beyond a face of said magnet, said base means includes an enclosed hollow housing having a lower member enclosing said housing adjacent said magnet holder, said enclosed housing further including an upper opening for coupling to said flexible gooseneck connection, said magnetic holder being affixed to said lower member, and said magnet has a central opening providing access to the base of said magnet holder, attachment means being positioned in said opening and attaching said base of said magnet holder to said lower member for attachment to or removal of said magnet holder from said lower member.

2. The light assembly according to claim 1 wherein said magnet is bonded to said base of said magnet holder by an adhesive.

3. The light assembly according to claim 1 further including an on-off switch means mounted within said enclosed housing, said switch means having an actuator accessible from the exterior of said housing.

4. The light assembly according to claim 1 wherein said gooseneck connection is provided by an elongated conduit having a plurality of interconnected segments, said segments being relatively movable with respect to each other to enable said gooseneck connection to assume a plurality of configurations.

5. The light assembly according to claim 4 further including a lamp housing surrounding said light socket, a reflector integrally connected to said lamp housing and mounted adjacent said light socket, said reflector having an open end from which light is emitted from said lamp.

6. The light assembly according to claim 5 wherein said reflector includes a plurality of cooling ports circumferentially surrounding said lamp, said cooling ports being formed by punching out portions of said reflector, said punched out portions being connected to said reflector at a position to block at least a portion of the light from said lamp to said ports.

7. The light assembly according to claim 6 wherein said reflector is formed with a continuous groove adjacent said opening, a wire grill being removably carried in said continuous groove, said wire grill having a circular wire periphery to be carried in said continuous groove, said circular periphery being split to facilitate removal of said grill.

* * * * *